US009483023B2

(12) United States Patent
Neboisa et al.

(10) Patent No.: US 9,483,023 B2
(45) Date of Patent: Nov. 1, 2016

(54) TIMEPIECE COMPRISING A DEVICE FOR DISPLAYING THE EQUATION OF TIME

(71) Applicant: GFPI SA, La Chaux-de-Fonds (CH)

(72) Inventors: Christophe Neboisa, Schüpfen (CH); Stephen Forsey, Les Brenets (CH)

(73) Assignee: GFPI SA, La Chaux-de-Fonds (CH)

( * ) Notice: Subject to any disclaimer, the term of this patent is extended or adjusted under 35 U.S.C. 154(b) by 0 days.

(21) Appl. No.: 14/895,683

(22) PCT Filed: Jun. 5, 2014

(86) PCT No.: PCT/EP2014/061684

§ 371 (c)(1),
(2) Date: Dec. 3, 2015

(87) PCT Pub. No.: WO2014/195403

PCT Pub. Date: Dec. 11, 2014

(65) Prior Publication Data

US 2016/0124387 A1 May 5, 2016

(30) Foreign Application Priority Data

Jun. 6, 2013 (CH) ..... 1076/13

(51) Int. Cl.
*G04B 19/26* (2006.01)
*G04B 19/24* (2006.01)

(52) U.S. Cl.
CPC ..... *G04B 19/262* (2013.01); *G04B 19/24* (2013.01)

(58) Field of Classification Search
CPC ..... G04B 49/02; G04B 49/04; G04B 19/262
See application file for complete search history.

(56) References Cited

U.S. PATENT DOCUMENTS 2,192,750 A * 3/1940 Mead ..... G04B 49/02 33/270
3,303,567 A * 2/1967 Blanks ..... G04B 49/02 33/270
4,645,354 A 2/1987 Mercer
6,826,122 B2 * 11/2004 Zaugg ..... G04B 19/23 368/28
9,261,859 B2 * 2/2016 Rochat ..... G04B 19/23

(Continued)

OTHER PUBLICATIONS

International Search Report mailed Aug. 5, 2015, issued in corresponding International Application No. PCT/EP2014/061684, filed Jun. 5, 2014, 5 pages.

(Continued)

*Primary Examiner* — Vit W Miska
*Assistant Examiner* — Jason Collins
(74) *Attorney, Agent, or Firm* — Christensen O'Connor Johnson Kindness PLLC

(57) ABSTRACT

The present invention relates to a timepiece comprising a frame and a device (1) for displaying the equation of time. The device (1) for displaying the equation of time comprises a first support (2) and a second support which are superposed, or, respectively, mounted so as to be able to rotate with respect to the frame, the first support (2) bearing a curve (6) that represents the equation of time, and the second support bearing a pointer (12) arranged such that the intersection of the pointer (12) with the curve (6) is visible, and means for driving the first (2) and second supports that are arranged such that the first (2) and second supports rotate at respective speeds that allow the value of the equation of time to be displayed at the intersection of the pointer (12) with the curve (6).

10 Claims, 6 Drawing Sheets

(56) References Cited

U.S. PATENT DOCUMENTS

2003/0029047 A1* 2/2003 Cheung ..... G04B 49/02 33/270
2012/0243380 A1* 9/2012 Goeller ..... G04B 19/262 368/15

OTHER PUBLICATIONS

Vardi, I., "La Marche du Soleil: Un Affichage Naturel de L'Équation du Temps," Société Suisse de Chronométrie, 62, Dec. 2009, 19 pages (with machine translation in English).

* cited by examiner

TIMEPIECE COMPRISING A DEVICE FOR DISPLAYING THE EQUATION OF TIME

TECHNICAL FIELD

The present invention relates to the field of mechanical timepieces. It more particularly relates to a timepiece comprising a device for displaying the equation of time.

BACKGROUND OF THE INVENTION

The equation of time is a parameter used in astronomy to report the relative visible movement of the Sun relative to the average sun, which can differ from one another by plus or minus approximately 15 minutes over the course of a year. From one year to the next, the annual evolution curve of this parameter repeats itself practically identically.

The average solar time is based on the average sun, defined as an object which moves over the equator at a constant speed throughout the year, such that the length of the average solar day is exactly 24 hours.

The solar time, or true time, is a measurement of the time based on the true sun, as given by a sundial. In particular, solar noon corresponds to the point of the day where the Sun reaches its highest point in the sky.

By convention, the equation of time is the quantity that must be added or removed each day to go from the true time to the average time, and corresponds, at a given moment, to the difference between the average solar time and the true solar time.

A positive value of the equation of time indicates that the true sun is behind relative to the average sun, i.e., more to the east, and a negative value indicates that it is in advance, i.e., further to the west. For example, when the time equation is equal to +8 minutes, this means that it is 12:08 in average solar time when the sundial indicates true noon.

There are already different display modes for the time equation that generally use a hand commanded by a cam of the equation of time provided inside a clockwork movement, said hand moving along fixed graduations displayed on the dial, to make it possible to display the value of the equation of time. Such a complication is for example shown diagrammatically by I. Vardi "La marche du soleil—Un affichage naturel de l'érequation du temps", Bulletin of the Société suisse de Chronométrie, SSC, Neuchâtel, CH, no. 62, Dec. 1, 2009, pages 37-44. However, according to this construction, the hand indicating the equation of time does not provide any tendency of the evolution of the equation of time for future months. The user does not know whether the difference between the average solar time and the true solar time will decrease, or on the contrary, increase.

One aim of the present invention is to propose a timepiece, such as a bracelet watch, allowing a dynamic and original new display of the equation of time.

BRIEF DESCRIPTION OF THE INVENTION

To that end, and according to the present invention, a timepiece is proposed, such as a bracelet watch, comprising a frame and a device for displaying the equation of time.

According to the invention, the device for displaying the equation of time comprises a first support and a second support that are superimposed, respectively mounted rotatably relative to the frame, the first support bearing a curve representative of the equation of time, and the second support bearing an index arranged so that the intersection of the index with the curve is visible, and means for driving the first and second supports arranged so that the first and second supports rotate at respective speeds making it possible to display the value of the equation of time at the intersection of the index with the curve.

According to a first alternative, the first support can be positioned on the side of the display and comprise a transparent zone where the curve is shown. Advantageously, the first support can be made from a transparent material.

According to a second alternative, the second support can be positioned on the display side and comprise a transparent zone on which the index is shown. Advantageously, the second support can be made from a transparent material.

Advantageously, the first support can also bear at least one piece of cyclic information related to the time chosen from among the group comprising the months, seasons, equinoxes, solstices.

Preferably, the index can assume the form of a graduated scale positioned radially.

According to one alternative, the index can be in the form of a graduated scale from −16 to +14.

According to another alternative, the index can be in the form of a graduated scale from 0 to 16, the curve representative of the equation of time then comprising first zones for which the value of the equation of time indicated by the index is negative and second zones for which the value of the equation of time indicated by the index is positive.

Thus, at any time, the user can quickly and easily read the equation of time by reading the value of the equation of time at the intersection of the index with the equation of time curve.

Furthermore, the representation of the entire equation of time curve makes it possible to provide the user with the tendency of the evolution of the equation of time for future months by following the illustrated curve.

BRIEF DESCRIPTION OF THE DRAWINGS

The invention will be better understood upon reading the following description of embodiments, provided as examples and done in reference to the drawings, in which.

DETAILED DESCRIPTION OF THE INVENTION

Figure 1:
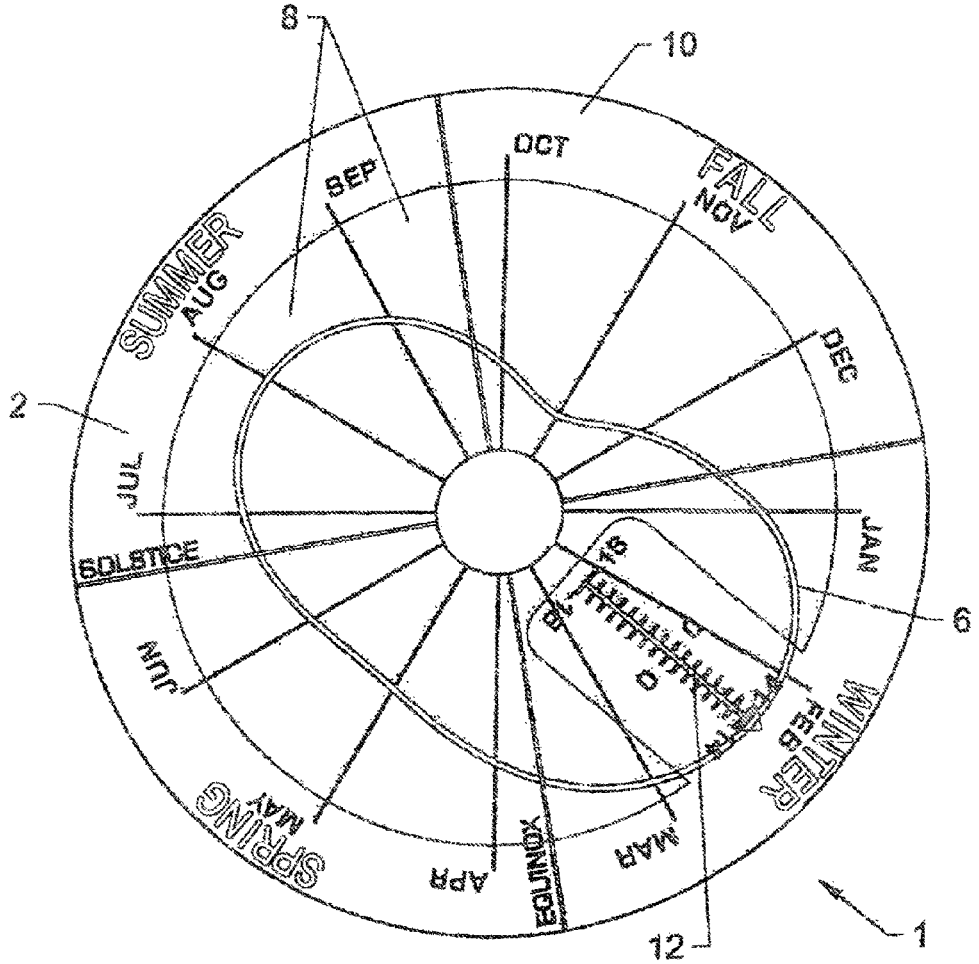
FIGS. 1 to 3 show a first embodiment of the display of the equation of time at different periods of the year.
Figure 4:
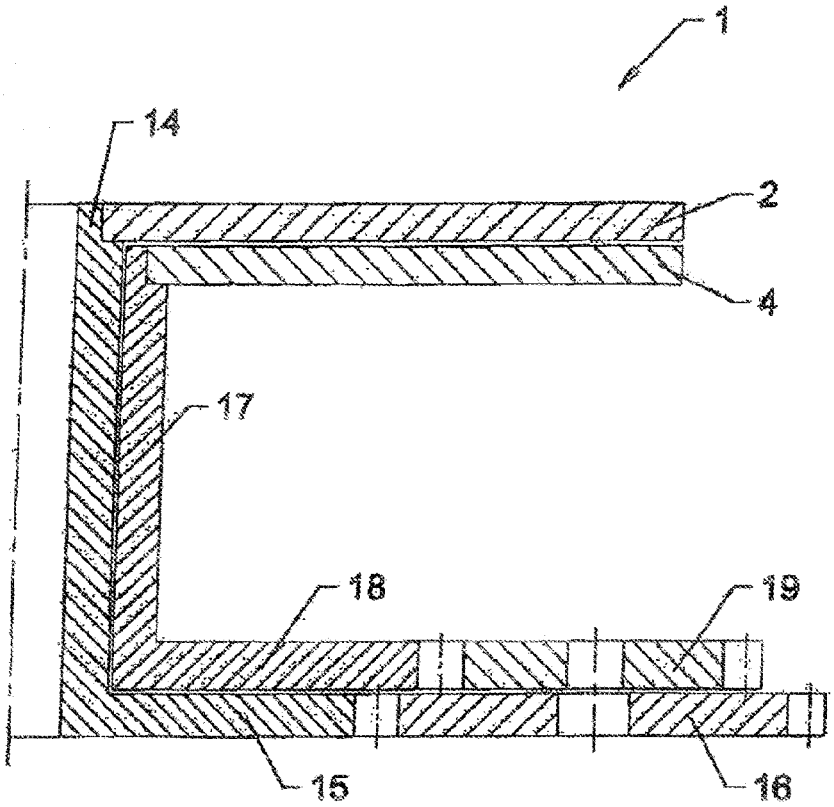
FIG. 4 shows a diagrammatic view of the display device used in the present invention.

FIGS. 1 and 4 show a device 1 for displaying the equation of time used according to the invention and comprising a first support 2 and a second support 4 that are superimposed, respectively mounted rotatably relative to the frame. In this alternative embodiment, the first and second supports 2 and 4 are respectively solid discs, concentric, hereinafter referenced first disc 2 and second disc 4.

Figure 2:
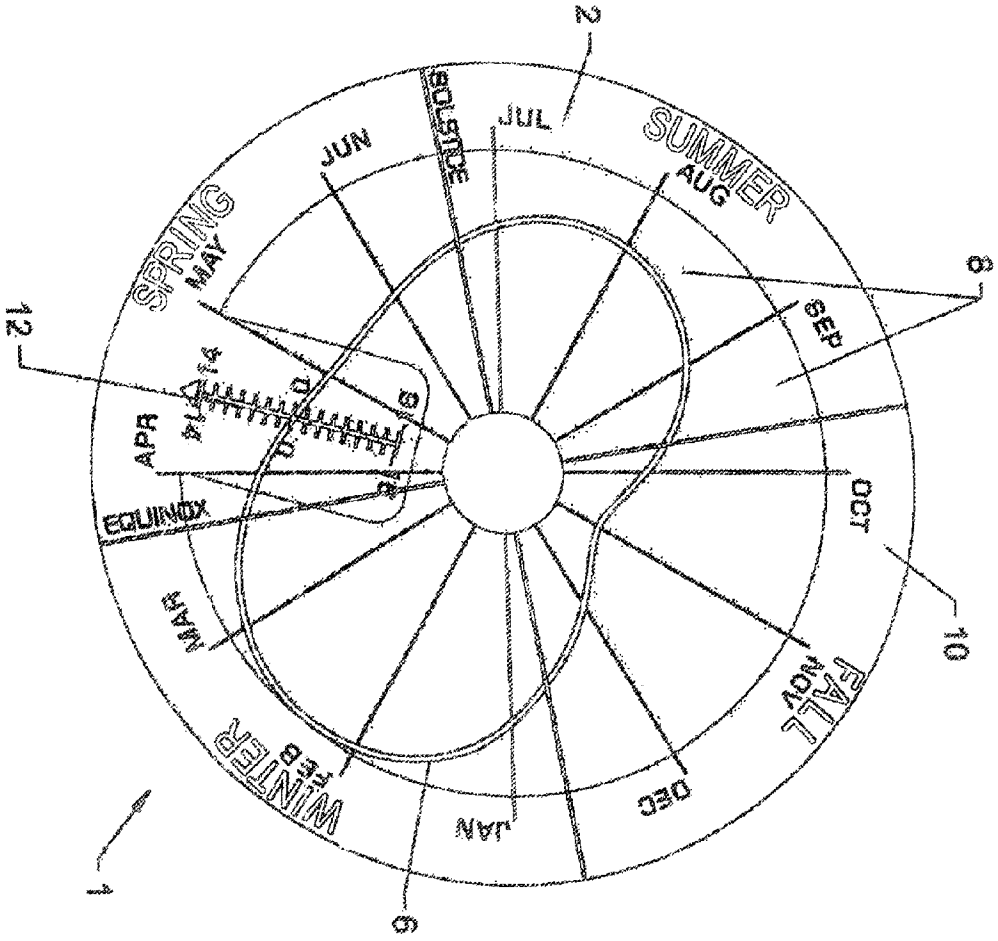
Figure 3:
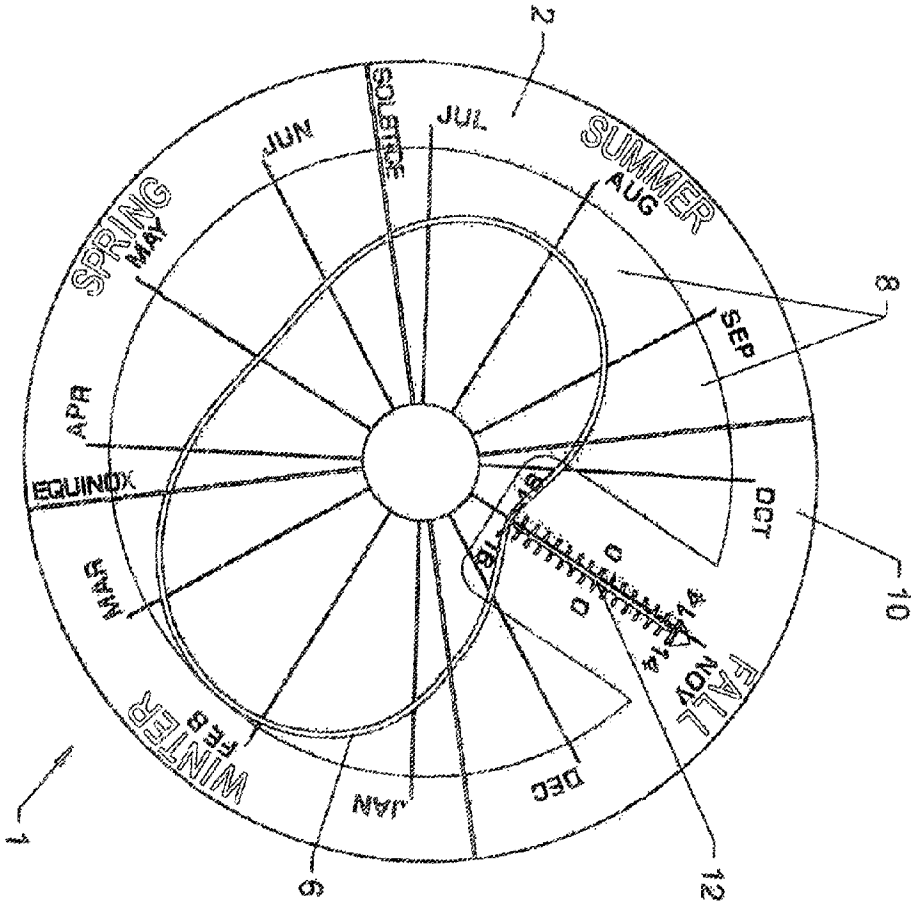

The first disc 2 bears a curve 6 representative of the equation of time. Curves making it possible to show the equation of time being known by one skilled in the art, their determination will not be described here. The curves are, however, chosen to represent the evolution of the equation of time over a year and to have a closed shape. The shape shown in FIGS. 1 to 3 is chosen to represent the equation of time varying from +14 minutes to −16 minutes.

The first disc 2 also comprises 12 angular sectors 8, regularly distributed, corresponding to the 12 months of the year. The name of one month is recorded per sector 8. The equation of time curve 6 is positioned on the first disc 2 relative to the months recorded in the sectors 8.

The first disc 2 also comprises 4 angular sectors 10, regularly distributed relative to the sectors 8 and corresponding to the four seasons. The name of one season is recorded per sector 10.

The second disc 4 bears an index 12 assuming the form of a graduated scale positioned radially.

In the alternative shown in FIGS. 1 to 3, the index 12 is in the form of a graduated scale from −16 to +14.

In order to leave all of the intersection points of the index 12 with the equation of time curve 6 visible, the first disc 2 is made from a transparent material. Of course, it suffices to provide at least one transparent zone on which the curve 6 is shown.

Also provided are means for driving the first disc 2 and the second disc 4. According to the invention, said driving means are arranged so that the first and second discs 2 and 4 rotate at respective speeds making it possible to display the value of the equation of time corresponding to the graduation of the index 12 at the intersection with the curve 6.

In reference to FIG. 4, one possible construction is to make the first disc 2 integral with a first staff 14. Said staff 14 is also secured to a toothed wheel 15 meshing with a toothed wheel 16 of the train of the movement of the timepiece. Likewise, the second disc 4 is made integral with a second staff 17, also secured to a toothed wheel 18 meshing with a toothed wheel 19 of the train of the movement of the timepiece. One skilled in the art knows how to choose the dimensions and the number of teeth of the wheels 15, 16, 18 and 19 so that the first disc 2 rotates at a speed of 330° per month and the second disc 4 rotates at a speed of 360° per month. Of course, the driving of the first and second discs 2 and 4 can be done through any other known driving mechanism, such as a differential, as long as the speed ratios of the first and second discs 2 and 4 are adapted to the equation of time to be displayed, i.e., 11 revolutions per year for the first disc 2 and 12 revolutions per year for the second disc 4.

The speed difference between the first and second discs 2 and 4 of 30° per month causes a shift between the curve 6 of the equation of time and the index 12. The user can read the equation of the time at the intersection of the curve 6 and the index 12 at any time.

Thus, according to FIG. 1, the user reads that for February 11, the value of the equation of time is +14 minutes.

According to FIG. 2, the user reads that for April 16, the value of the equation of time is 0 minutes.

According to FIG. 3, the user reads that for November 4, the value of the equation of time is −16 minutes.

Figure 5:
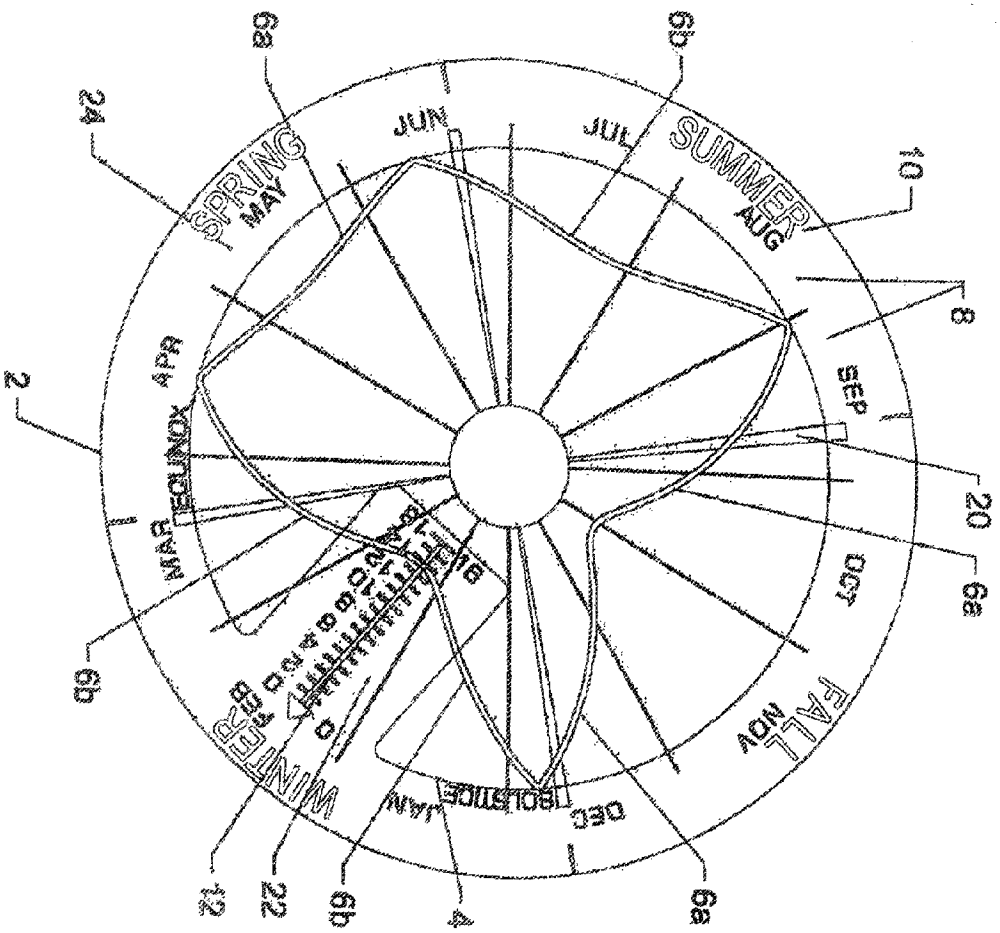
FIG. 5 shows a second embodiment of the display of the equation of time.

In reference to FIG. 5, another alternative embodiment of the timepiece according to the invention is shown, in which the index 12 provided on the second disc 4 is in the form of a graduated scale from 0 to 16. This alternative makes it possible to offer easier reading with a scale offering better readability.

In this case, the curve 6 of the equation of time shown on the first disc 2 comprises first zones 6*a* for which the value of the equation of time indicated by the index is negative and second zones 6*b* for which the value of the equation of time indicated by the index is positive.

Thus, the first zones 6*a* correspond to the average solar time, behind relative to the true solar time, and the second zones 6*b* correspond to the average solar time, ahead relative to the true solar time. The zones 6*a* and 6*b* can be shown in different colors, to differentiate between them.

The first disc 2 bears, as for the first alternative, the sectors for the months 8 and the sectors for the seasons 10. Furthermore, a representation is provided of the equinoxes and solstices in the form of a cross 20 supported by the first disc 2.

The first disc 2 is made from a transparent material and the second disc 4 comprises, around the index 12, a colored zone 22 improving the contrast to facilitate the reading of the equation of time. The second disc 4 also comprises a colored peripheral zone 24 improving the contrast to facilitate the reading of the months, seasons, equinoxes and solstices.

Thus, according to FIG. 5, the user reads that for February 11, the value of the equation of time is +14 minutes, since the index is in a zone where the values of the equation of time are positive.

Of course, the direction of rotation of the first and second discs 2 and 4 can be clockwise or counterclockwise, depending on the desired configuration.

Figure 6:
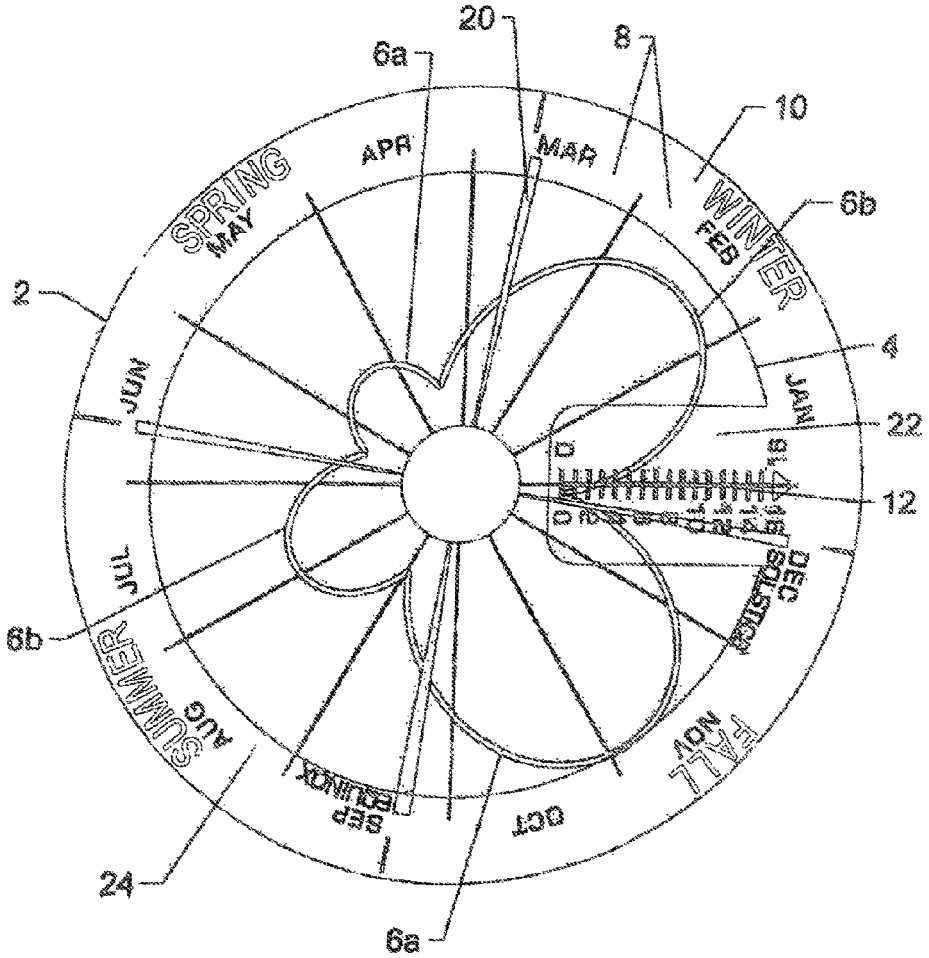
FIG. 6 shows a third embodiment of the display of the equation of time.

Thus, FIG. 6 shows another alternative embodiment according to the invention. The references indicate the same elements as those described above. In this alternative, the direction of rotation of the system is counterclockwise. The indications found on the first disc 2, such as the seasons, months, solstices and equinoxes, are reversed.

Of course, the shape of the equation of time curve can also be modified in particular by adapting the speed ratios between the first and second discs. In general, the shape of the equation of time curve 6 can be shown in the form of a so-called "standard" polar curve (as shown in FIGS. 1 to 3), but also in the form of a reverse absolute polar curve (as shown in FIG. 5) or in the form of an absolute polar curve (as shown in FIG. 6). One skilled in the art knows other shapes of the equation of time curve that may be used as preferred.

In the alternative shown herein, the first disc 2 is positioned above the second disc 4, on the dial side, as close as possible to the gaze of a user looking at the display.

Of course, a reverse construction is possible by adapting the transparency zones to make it possible to make each of the intersection points of the equation of time curve with the index visible.

More particularly, the second disc can be positioned on the display side and comprise a transparent zone on which the index is shown. Advantageously, the second disc is made from a transparent material.

It is also possible to provide a stack of several transparent discs making it possible to display different information by superposition.

According to other alternative embodiments that are not shown, the first support can also assume the form of a circular element resulting from a photolithography method and including the curve as well as the inscriptions (months, years, solstices, etc.), cut out and with no physical substrate, only the arms of the first support connecting the felloe to the central hub.

Likewise, second support can assume the form of an element resulting from a photolithography method including only the cutout scale. The second support also assume the form of a hand directly bearing the graduated scale.

In another alternative embodiment that is not shown, the first and second supports can be arranged non-concentrically. The second support then assumes the form of a planetary wheel positioned non-concentrically relative to the first support. The second support includes an outer toothing arranged to cooperate on the one hand with an inner toothing provided on the first support and on the other hand with the toothing of an additional pinion mounted stationary or moving on the frame. The second support includes a graduation (+14; −16) adapted based on the shape of the curve representative of the equation of time as well as the relative speeds of rotation between the first support and the second support.

When the first support is rotated, it meshes, by means of the inner toothing, with the outer toothing of the second support, which will therefore also begin to rotate and mesh with the toothing of the additional pinion.

If this additional pinion is stationary, the second support will rotate around its own axis and around the additional pinion. The equation of time will be read at the intersection of the curve representative of the equation of time carried by the first support and the graduation carried by the second support. The reading will then be done in a different location around the first support each time.

If the additional pinion is moving, the second support will rotate around its own axis, but without rotating around the additional pinion. The equation of time will still be read at the intersection of the curve representative of the equation of time and the graduation carried by the second support, but in this case still in the same location on the first support.

The invention claimed is:

1. A timepiece comprising a frame;

a device for displaying the equation of time, comprising a first support and a second support that are superimposed, respectively mounted rotatably relative to the frame;

wherein the first support bears a curve representative of the equation of time, and wherein the second support bears an index arranged so that the intersection of the index with the curve is visible; and means for driving the first and second supports arranged so that the first and second supports rotate at respective speeds making it possible to display the value of the equation of time at the intersection of the index with the curve.

2. The timepiece according to claim 1, wherein the first support is positioned on the side of the display and comprises a transparent zone where the curve (6) is shown.

3. The timepiece according to claim 2, wherein the first support is made from a transparent material.

4. The timepiece according to claim 1, wherein the second support is positioned on the display side and comprises a transparent zone on which the index is shown.

5. The timepiece according to claim 4, wherein the second support is made from a transparent material.

6. The timepiece according to claim 1, wherein the first support also bears at least one piece of cyclic information related to the time chosen from among the group comprising the months, seasons, equinoxes, solstices.

7. The timepiece according to claim 1, wherein the index assumes the form of a graduated scale positioned radially.

8. The timepiece according to claim 7, wherein the index is in the form of a graduated scale from −16 to +14.

9. The timepiece according to claim 7, wherein the index is in the form of a graduated scale from 0 to 16, and in that the curve representative of the equation of time comprises first zones for which the value of the equation of time indicated by the index is negative and second zones for which the value of the equation of time indicated by the index is positive.

10. The timepiece according to claim 1, wherein the first support rotates at a speed of 330° per month and the second support rotates at a speed of 360° per month.

* * * * *